United States Patent [19]

Harris

[11] Patent Number: 4,852,366

[45] Date of Patent: Aug. 1, 1989

[54] HEAT PUMP AND SYSTEM

[75] Inventor: Kenneth J. Harris, Chardon, Ohio

[73] Assignee: Conserve, Inc., Erie, Pa.

[21] Appl. No.: 941,762

[22] Filed: Dec. 15, 1986

[51] Int. Cl.[4] ..... F25B 27/00

[52] U.S. Cl. ..... 62/238.6; 237/2 B

[58] Field of Search ..... 237/1 R, 2 B, 12.1; 62/506, 323.1, 324.1, 238.6

[56] References Cited

U.S. PATENT DOCUMENTS

| | | | |
|---|---|---|---|
| 2,314,591 | 3/1943 | McCormack | 62/468 |
| 2,668,420 | 2/1954 | Hammell | 62/238.6 |
| 4,517,799 | 5/1985 | Hanaoka et al. | 62/238.6 X |
| 4,621,501 | 11/1986 | Tanaka | 62/513 |

FOREIGN PATENT DOCUMENTS

| | | | |
|---|---|---|---|
| 2116301 | 9/1980 | United Kingdom | 62/238.6 |

*Primary Examiner*—Henry A. Bennet

*Attorney, Agent, or Firm*—Renner, Otto, Boisselle & Sklar

[57] ABSTRACT

A heat pump installation for generating, for example, either hot water or cool air utilizing a low grade heat source. The installation comprises an oil filled inner tank having mounted and immersed therein an electric motor-compressor unit and an external tank for heating and circulating such water having mounted therein the inner tank in such a manner as to avoid contamination of the oil by the water. Mounted near the bottom of the outer tank in the immediate proximity of the cold water intake is an internal sub-cooling coil which helps to increase the efficiency of the installation. Also, to further increase the efficiency of the installation, preferably there is included an external sub-cooling coil mounted externally from the external tank. Such external sub-cooling coil comprises a primary coil through which the major portion of the refrigerant flows and a secondary coil which serves to withdraw heat from the primary coil. When the heat pump installation utilizes as a low grade heat source exhaust gases or combustion products flowing through an exhaust pipe, the invention further provides for a heat exchanger for deriving the heat from such exhaust gases. The heat exchanger may easily be spliced into an existing exhaust pipe thus allowing the exchanger to withdraw heat from the exhaust gases without substantially diverting the flow of such gases.

34 Claims, 2 Drawing Sheets

HEAT PUMP AND SYSTEM

DISCLOSURE

This invention relates to a heat pump installation. More specifically, this invention relates to a heat pump installation capable of utilizing a low grade heat source to produce either hot or cold water and air.

BACKGROUND

Heat pumps have been utilized for many years for the purposes of heating and cooling both water and air. Recently, heat pump installations have been modified and improved in such a manner as to allow such installations to operate efficiently utilizing a low grade heat source. Applicant's copending continuation application entitle "Heat Pump", Ser. No. 762,550, filed Aug. 2, 1985, discuss such heat pump installations.

Although such heat pumps provide an efficient means of heating and cooling, there is a continual drive to improve the efficiency and reliability of such installations. Furthermore, there is a continual need to make heat pump installations more adaptable to existing heating devices and their environments. The instant invention satisfies existing needs by providing a heat pump installation which is lower cost, more reliable, efficient, compact and adaptable than prior art devices.

SUMMARY OF THE INVENTION

The present invention provides a heat pump installation for both heating and cooling having improved efficiency and reliability. The invention further provides a heat pump installation which may easily be adapted to an existing low grade heat source and its surrounding environment.

In a preferred embodiment, a heat pump installation made in accordance with the present invention comprises an oil filled inner tank having mounted and immersed therein a sealed electric motor-compressor unit and an external tank for heating and circulating water having mounted therein the inner tank. The inner tank is mounted within the external tank in such a manner as to prohibit the contamination of the oil by the water or vice versa.

In addition to the internal tank and compressor unit being mounted in the external tank, there is included therein a condenser which transfers the heat imparted into the refrigerant by the compressor to the water. Also mounted within the external tank near its base in the immediate proximity of the cold water intake is an internal sub-cooling coil. The internal sub-cooling coil serves to improve the efficiency of the installation by cooling the refrigerant as much as possible before the refrigerant enters the evaporator.

To further improve the efficiency of the installation, particularly when the intake water is not at that low a temperature, for example when the water is being utilized for space heating, the installation further includes an external sub-cooling coil mounted externally or outside of the external tank. The external sub-cooling coil comprises a primary tube which channels a major portion of the refrigerant flowing to the evaporator and a secondary tube which channels only a minor portion of the refrigerant. The secondary tube, which is fed a minor portion of the refrigerant flowing to the evaporator via a capillary tube, surrounds the primary tube and serves to withdraw as much heat as possible from the refrigerant flowing through the primary tube.

In addition to the aforementioned features the invention further provides a heat exchanger for withdrawing heat, for use by the installation, from exhaust gases traveling through a convention exhaust pipe. Such heat exchanger is capable of withdrawing heat from the exhaust gases without re-routing the exhaust pipe or substantially interfering with the flow of the gases through the pipe.

The heat exchanger comprises a primary exchanger pipe having substantially the same configuration as the existing exhaust pipe, so as to allow the primary exchanger pipe to be spliced into the existing exhaust pipe, and a secondary exchanger pipe encircling the primary pipe and providing a gap therebetween. Mounted along the inside diameter of the primary pipe are a plurality of heat conducting fins which cause the heat in the exhaust gases to radiate to the outside diameter of the primary pipe. Within the gap between the primary and secondary pipe there is provided a heat conductive filter material. Ambient air, which is drawn through the secondary pipe and the filter material is heated by the exhaust gases and primary pipe, is directed by the secondary pipe for use by the heat pump installation.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various way in which the principles of the invention may be employed.

DETAILED DESCRIPTION OF PREFERRED EMBODIMENTS

Figure 1:
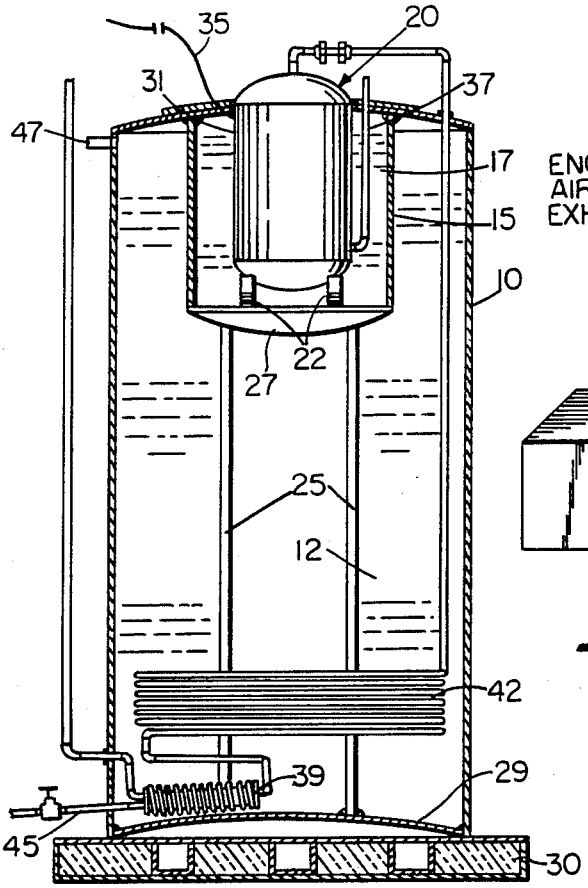
FIG. 1 is a cross-sectional view of the external tank illustrating the components contained therein of a heat pump installation made in accordance with the present invention.

Referring to the drawing and initially to FIG. 1, there is illustrated an external tank 10 and its associated components which comprise a portion of a heat pump installation made in accordance with the present invention. The external tank 10, which is filled with water 12, has mounted therein and immersed in such water 12 an internal tank 15. The internal tank 15 which is filled with oil 17, has mounted therein and immersed in such oil 17 a sealed electric motor-compressor unit 20. Note, the internal tank 15 is mounted within the external tank 10 in such a manner as to seal the contents of the internal tank 15 off from the contents of the external tank 10 and thus prevent contamination or the intermixing of the oil 17 and water 12. Preferably, in order to minimize vibration and dampen noise, the motor-compressor unit 20 is mounted within the internal tank 15 upon springs 22. To ensure the structural integrity of the mounting of internal tank 15 within the external tank 10, there is provided a pair of stanchions 25 which extend from the base 27 of the internal tank 15 to the bottom 29 of the external tank 10. Also, in order to elevate and insulate the tank from the floor or surface upon which the external tank 10 is sitting, a platform 30 is provided.

The sealed motor-compressor unit 20 is conventional in nature containing both a compressor and an electric motor. The motor-compressor unit 20, which preferably has rotary motion, ejects heated refrigerant gas into the hermetically sealed container 31 which houses the electric motor that drives the compressor. Generally, the temperature of the compressed refrigerant leaving the compressor and going into the sealed container 31 is on the order of 215° F. Thus, the electric motor driving the compressor will be at a temperature in excess of 215° F. In fact, generally the motor will be cooled by such compressed refrigerant.

It is recognized that the higher the temperature of an electric motor the less efficient it is and the greater its current requirements become. This inefficiency manifests itself in the form of heat. Such heat generation can create a "snowball effect" which leads to even lower efficiency and greater current requirements and eventually to the burn-out of the electric motor. To avoid this "snowball effect" in a convention heat pump installation, the compressor and motor are generally cooled by circulating air. Unfortunately, the cooling effect of circulating air is less than optimum because circulating air can effectively cool only one side of an object, the side on which the air is directed.

As disclosed in applicant's copending application, if the motor-compressor unit is immersed in a liquid which is constantly being replaced, the unit will run at a temperature near that of the liquid. Specifically, if the heat pump installation FIG. 1 is being used to produce water at 150° F., the immersed motor-compressor unit 20 will run at a temperature of about 165° F. to 170° F. Such a low operating temperature leads to an increased service life for the motor-compressor unit 20.

Immersing the motor-compressor unit 20 in oil 17 which is in thermal contact with the water 12, instead of directly immersing the unit in the water 12, provides several distinct advantages. First of all, because oil has a boiling point well above that of water, the oil 17 should never evaporate and condensate on the electrical contacts 35 which are located near the top of the motor-compressor unit 20. Thus, because the possibility of such condensation has been eliminated, there is no need to insulate the contacts 35 from the oil 17, nor is there a risk of an electrical short developing in the event such insulation should fail. Immersion in oil 17 also provides another advantage in that, should the low pressure refrigerant return line 37 develop a leak, the motor-compressor unit 20 will draw in oil 17, and not water 12 which could seriously damage the unit 20. Finally, by immersing the motor-compressor unit 20 in the oil 17, there is no need to add rust inhibitors to the water 12 to protect the unit 20 from the corrosive effects of the water 12.

In addition to the oil immersed motor-compressor unit 20, applicant's invention further provides for an internal sub-cooling coil 39 which improves the efficiency of the heat pump installation. The subcooling coil 39 is tied into the refrigerant flow lines immediately after the condensor 42 which serves to dissipate the majority of the heat contained in the high pressure refrigerant flowing from the motor-compressor unit 20. The purpose of the sub-cooler 39 is to maximize the amount of heat removed from the refrigerant and thus minimize the temperature of the refrigerant as much as possible before it enters the evaporator. To effectuate such heat removal from the refrigerant, the sub-cooler 39 is located at the base of the external tank 10 in the immediate proximity of coil water intake 45, wherein the coolest water in the external tank 10 should be located, the water rising as it is heated by the condensor 42 and exiting through output line 47 located near the top of the external tank 10. In this embodiment, the intake line 45 directs the flow of cold water through the center of sub-cooling coil 39 to effectuate maximum heat removal.

Figure 2:
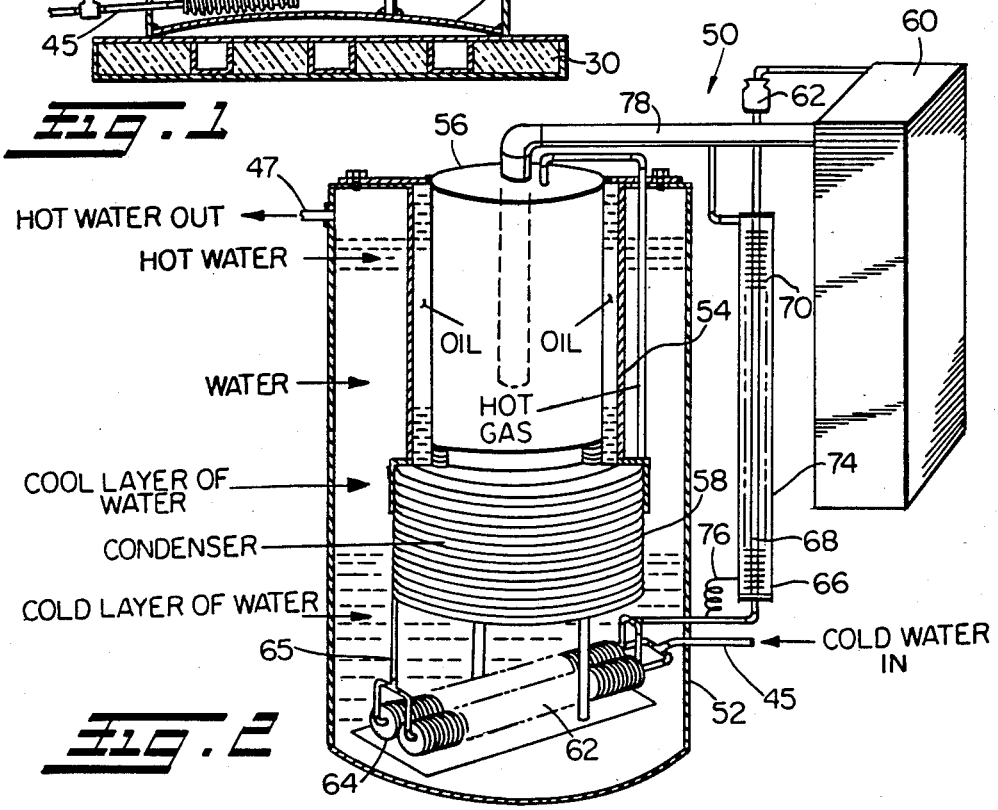
FIG. 2 is another embodiment of the present invention illustrating a cross-sectional view of another form of the external tank and the components contained therein.

Referring now to FIG. 2 there is illustrated another embodiment of a heat pump installation 50 made in accordance with the teachings of the present invention. As with the previously illustrated embodiment the installation 50 comprises a water filled external tank 52 and an oil filled internal tank 54 having immersed therein a sealed electric motor-compressor unit 56. The installation 50 also includes a condensor 58, an evaporator unit 60, and an expansion valve 62.

In order to improve the efficiency of the installation 50 a pair of internal sub-cooling coils 62 and 64, which are tied into the refrigerant flow lines immediately after the condensor 58, are situated at the base of external tank 52. Sub-cooling coils 62 and 64, which function and serve the same purpose as sub-cooling coil 39 illustrated in FIG. 1, each receive approximately one-half the refrigerant flowing from the tub 65. Note, although in this embodiment two internal sub-cooling coils are shown, it will be appreciated that any number of such sub-coolers may be utilized depending upon, for example, the size and configuration of the heap pump installation.

In addition to sub-cooling coils 62 and 64, the installation 50 includes an additional external sub-cooling coil 66. External sub-cooling coil 66 can be extremely valuable with respect to improving the efficiency of an installation when such installation is being used to heat recirculating water for a space heater. In such a recirculating installation the return line water or cold water would be approximately 75° F., versus for example, 45° F. to 50° F. when the installation is being used to heat well or city water for use in a domestic hot water supply. Thus, in a recirculating installation the refrigerant would still contain a significant amount of heat after it exited sub-cooling coils 62 and 64.

External sub-cooling coil 66 improves the efficiency of the installation 50 by removing additional heat from the refrigerant after it exits internal sub-cooling coils 62 and 64, and prior to it entering evaporator 60. The external sub-cooling coil 66 comprises an inner tube 68 equipped with a plurality of heat conducting fins one of which is indicated at 70, and an outer tube 74 which coils around and surrounds the inner tube 68 in such a manner as to allow the outer tube 74 to withdraw heat from the inner tube 68. The primary tube 68 carries the major portion of the refrigerant exiting sub-cooling coils 62 and 64 while the outer tube 74 carries only a minor portion of such refrigerant. Such minor portion of refrigerant or bleed-off is provided by a capillary tube 76. The refrigerant is drawn up through the capillary tube 76 and the outer tube 74 because the end of the outer tube 74 is connected to the main suction or return line 78, thus creating a negative pressure. As the refrigerant expands in the outer tube 74, the outer tube becomes in essence a small refrigerator which withdraws heat from the refrigerant flowing in the inner tube 68. Note, as with the internal sub-coolers, a heat pump installation may be provided with any number of external sub-coolers depending upon for example the size and configuration of such installation.

Figure 3:
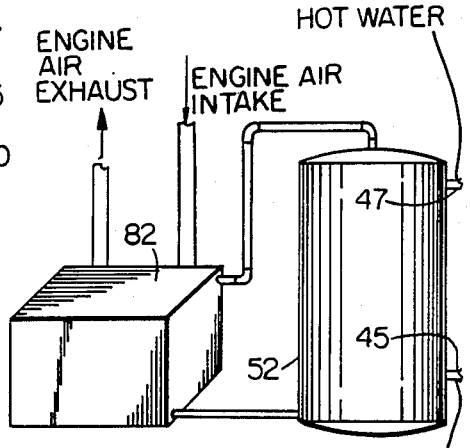
FIG. 3 is a schematic view of the invention for use in combination with an internal combustion engine.

Referring now to FIG. 3 there is schematically illustrated a heat pump installation wherein a heat pump installation in accordance with the present invention is used in combination with an internal combustion engine. In this particular embodiment the installation's evaporator is contained in a heat and sound insulating container 82 with such internal combustion engine.

Figure 5:
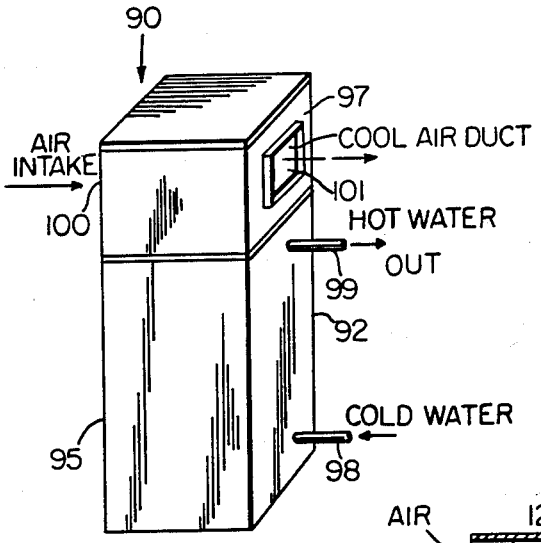
FIG. 5 is a schematic perspective side view of an embodiment of the invention in one of its most compact forms.

Referring now to FIG. 5 there is schematically illustrated an embodiment of the invention wherein the entire installation 90 is contained in a single housing 92. In this embodiment the external tank and its associated components are contained in the lower portion 95 of the container 92 and the evaporator is contained in the upper portion 97. Cold water enters the external tank through intake line 98 at the bottom of the lower portion 95 and hot water exits the external tank near the top of the lower portion 95 via output line 99. Ambient air at 100 is drawn in one side of the upper portion 97 by a blower or fan and exits at 101 at a reduced temperature after having passed over the evaporator contained therein. With components of the invention arranged in this manner, the installation 90 may easily be adapted to locations and environments wherein previous arrangement of the installation could not previously have been placed.

Figure 4:
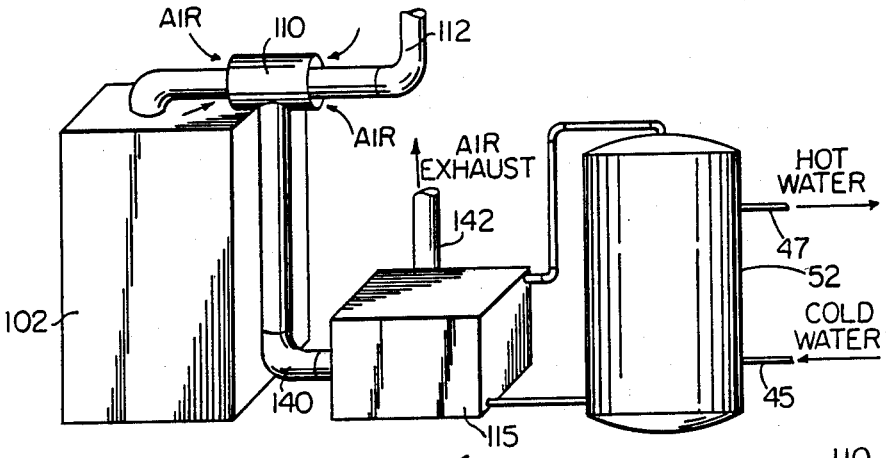
FIG. 4 is a schematic view of the present invention utilizing the exhaust gases from a combustion furnace as a low grade heat source.

Referring now to FIG. 4 there is illustrated an embodiment of the invention which utilized as a low temperature heat source exhaust gases emanating from a combustion furnace 102. The combustion furnace 102 may be fired with any one of a variety of fuels, for example, natural gas, propane, oil, or the like. In this embodiment the removal of heat from the exhaust gases is accomplished with no substantial rerouting of the gases by utilizing a heat exchanger 110 which is easily spliced into the existing exhaust pipe 112. The exchanger 110 removes the heat from the exhaust gases and pipe 112 and directs such heat to a container 115 having contained therein an evaporator.

Figure 7:
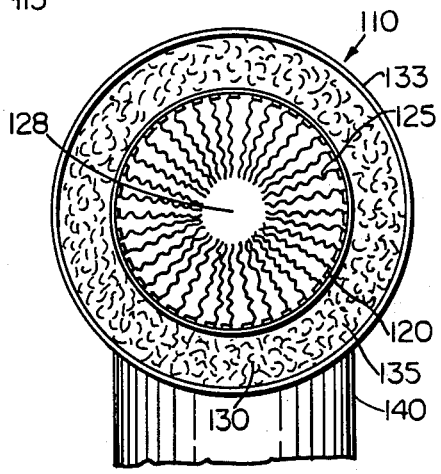
FIG. 7 is a side view of the heat exchanger illustrated in FIG. 6.
Figure 6:
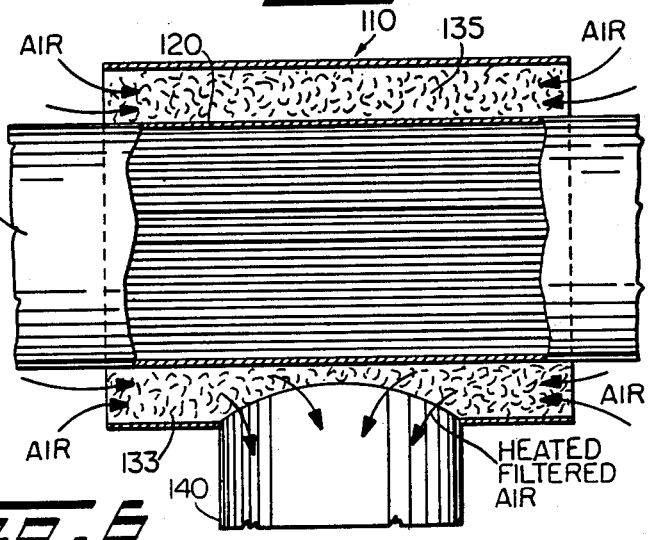
FIG. 6 is a fragmentary broken away view of the heat exchanger schematically illustrated in FIG. 4 which is utilized by the present invention to withdraw heat from the exhaust gases traveling in an exhaust pipe.

Referring now additionally to FIGS. 6 and 7, two view of the exchanger 110 are illustrated. The exchanger 110 comprises a primary exchanger pipe 120 having the approximate configuration of the exhaust pipe 112 so as to allow the primary pipe 120 to be easily spliced into the exhaust pipe 112. Mounted along the inside diameter of the primary pipe 120, preferably by welding, are a plurality of heat conducting fins one of which is designated 125. Such fins extend radially inward toward the horizontal axis 128 of the heat exchanger 110. Surrounding the primary pipe 120 and creating a gap 130 is an outer tube 133. The gap 130 is filled with a filtering material 135. Preferably, such filter material 135 comprises a heat conductive material such as copper so as to promote the removal of heat from the exhaust gases and the primary pipe 120.

The exchanger 110 operates by drawing air through gap 130. While in gap 130, the air is heated by conduction, convection, radiation, or the like and is drawn into flow pipe 140 by a small blower and directed for use by the evaporator mounted in contained 115. Once the heated air has passed over the evaporator coils the air is exhausted through pipe 142.

Although in the previously illustrated embodiments of the heat pump installations, the external tanks of such installations have been utilized to heat water, it will be appreciated that the direction of refrigerant flow within the installation may be reversed such that the water flowing into the external tank may be used as a low grade heat source and what was once a condenser in the external tank begins to function as an evaporator (i.e., it begins to withdraw heat from the incoming water). Likewise, when such installation is reversed, what was once the evaporator begins to function as a condenser (i.e., it begins to radiate or provide a source of heat).

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A heat pump installation comprising a motor-compressor unit, an outer tank containing a liquid, an inner tank having oil or the like contained therein, said inner tank being mounted within and sealed from said outer tank so as to prevent the intermixing of said liquid and said oil, and said motor-compressor unit being sealed from and mounted within said inner tank such that at least a portion of said motor-compressor unit is immersed in said oil.

2. A heat pump installation as set forth in claim 1 wherein said liquid contained in said outer tank comprises water.

3. A heat pump installation as set forth in claim 2 further including an internal sub-cooling coil located within the confines of said outer tank.

4. A heat pump installation as set forth in claim 3 wherein said internal sub-cooling coil is mounted near the bottom of said outer tank such that said internal sub-cooling coil is completely immersed in said water contained therein.

5. A heat pump installation as set forth in claim 4 wherein said motor-compressor unit is mounted within said inner tank upon at least one spring so as to minimize vibration and dampen sound.

6. A heat pump installation as set forth in claim 1 further including an external sub-cooling coil mounted externally from said outer tank, said external sub-cooling coil comprising an inner tube, and outer tube, and a capillary tube feeding a minor amount of refrigerant to said outer tube such that said outer tube serves to remove heat from said inner tube and such refrigerant flowing therein.

7. A heat pump installation for converting cold water to hot water comprising an outer tank containing such water, an inner tank having oil or the like contained therein mounted within said outer tank so as to prevent the contamination of said oil by such water, and a sealed motor-compressor unit mounted within said inner tank and at least partially immersed in said oil contained therein.

8. A heat pump installation as set forth in claim 7 wherein said outer tank further includes an intake opening at the bottom portion of said outer tank for channeling the ingress of such cold water into said outer tank.

9. A heat pump installation as set forth in claim 8 further including an internal sub-cooling coil mounted within the bottom portion of said outer tank such that such cold water flowing from said intake opening initially flows in the immediate proximity of said internal sub-cooling coil.

10. A heat pump installation as set forth in claim 9 wherein said internal sub-cooling coil is positioned with respect to said intake opening so that such cold water initially flows through the center of said internal sub-cooling coil.

11. A heat pump installation as set forth in claim 7 wherein said sealed compressor unit is mounted within said inner tank upon at least one spring so as to minimize vibrations and dampen sound emanating from said motor-compressor unit.

12. A heat pump installation as set forth in claim 9 further including an external sub-cooling coil located externally from said outer tank.

13. A heat pump installation for converting cold water to hot water comprising a tank for containing such water having an intake opening at the bottom portion of said tank for channeling the ingress of such cold water into said tank, a sealed motor-compressor unit, a condensor, an evaporator, and an internal sub-cooling coil, said internal sub-cooling coil being mounted in the bottom portion of said tank such that such cold water flowing from said intake opening initially flows in the immediate proximity of said internal sub-cooling coil, said heat pump installation further including an external sub-cooler for further reducing the temperature of the refrigerant flowing therein, said external sub-cooler comprising a primary tube, a secondary tube and a capillary tube, said primary tube serving to direct the flow of the major portion of such refrigerant, and said secondary tube which is fed a minor portion of such refrigerant by said capillary tube serving to withdraw heat from said primary coil and the refrigerant contained therein.

14. A heat pump installation as set forth in claim 13 wherein said primary tube of said external sub-cooler includes a plurality of heat conducting fins to enhance the ability of said primary tube to dissipate heat.

15. A heat pump installation as set forth in claim 13 wherein said secondary tube of said sub-cooler surrounds at least a portion of said primary tube of said sub-cooler.

16. A heat pump installation utilizing as a low grade heat source exhaust gases traveling within an exhaust pipe connected to a source of such exhaust gases comprising a compressor, condenser, evaporator and heat exchanger means for deriving heat from such exhaust gases traveling within such exhaust pipe, said heat exchanger means comprising a primary exchanger pipe having approximately the same diameter as such exhaust pipe and being spliced into such exhaust pipe, and a secondary exchanger pipe encircling said primary exchanger pipe in such a manner as to create a gap between the outside of said primary exchanger tube and the inside diameter of said secondary exchanger tube so as to allow air to be channeled through such gap and heated by such exhaust gases traveling within said primary exchanger pipe and directed for use by said heat pump installation.

17. A heat pump installation as set forth in claim 16 wherein said primary exchanger pipe includes a plurality of heat conducting fins securely mounted to the inside diameter of said primary exchanger pipe.

18. A heat pump installation as set forth in claim 17 wherein said heat conducting fins are welded to the inner diameter of said primary exchanger pipe and are directed to or converge upon the horizontal axis of said primary exchanger pipe.

19. A heat pump installation as set forth in claim 18 wherein such gap formed between said inside diameter of said secondary exchanger pipe and the outside diameter of said primary exchanger pipe is at least partially filled with a filter material.

20. A heat pump installation as set forth in claim 19 wherein said filter material comprises a heat conducting material.

21. A heat pump installation as set forth in claim 19 wherein said heat conducting filter material comprises copper.

22. A heat pump installation of converting cold water to hot water comprising an outer tank containing such water, an inner tank having oil or the like contained therein mounted within said outer tank so as to prevent the contamination of said oil be said water and a sealed motor-compressor unit mounted within said inner tank and at least partially immersed in said oil contained therein, said sealed motor-compressor unit being normally isolated from fluid communication with said oil or the like.

23. A heat pump installation as set forth in claim 22 wherein said outer tank further includes an intake opening at the bottom portion of said outer tank for channeling the ingress of such cold water into said outer tank.

24. A heat pump installation as set forth in claim 23 further including an internal sub-cooling coil mounted within the bottom potion of said outer tank such that such cold water flowing from said intake opening initially flows in the immediate proximity of said internal sub-cooling coil.

25. A heat pump installation as set forth in claim 24 wherein said internal sub-cooling coil is positioned with respect to said intake opening so that such cold water initially flows through the center of said internal sub-cooling coil.

26. A heat pump installation as set forth in claim 22 wherein said sealed compressor unit is mounted within said inner tank upon at least one spring so as to minimize vibrations and dampen sound emanating from said motor-compressor unit.

27. A heat pump installation as set forth in claim 23 further including an external sub-cooling coil located externally from said outer tank.

28. A heat pump installation comprising a motor-compressor unit, an outer tank containing a liquid, an inner tank having oil or the like contained therein, said inner tank being mounted within and sealed from said outer tank so as to prevent the intermixing of said liquid and said oil, and said motor-compressor unit being mounted within said inner tank such that at least a portion of said motor of said motor-compressor unit is in cooling communication with said oil.

29. A heat pump installation as set forth in claim 2 wherein said liquid contained in said outer tank comprises a water.

30. A heat pump installation as set forth in claim 29 further including an internal sub-cooling coil located within the confines of said outer tank.

31. A heat pump installation as set forth in claim 30 wherein said internal sub-cooling coil is mounted near the bottom of said outer tank such that said internal sub-cooling coil is completely immersed in said water contained therein.

32. A heat pump installation as set forth in claim 31 wherein said motor-compressor unit is mounted within said inner tank upon at least one spring so as to minimize vibration and dampen sound.

33. A heat pump installation as set forth in claim 28 further including an external sub-cooling coil mounted externally from said outer tank, said external sub-cooling coil comprising an inner tub, an outer tube, and a capillary tube feeding a minor amount of refrigerant to said outer tube such that said outer tube serves to remove heat from said inner tube and such refrigerant flowing therein.

34. A heat pump installation for converting cold water to hot water comprising a tank for containing such water having an intake opening at the bottom portion of said tank for channeling the ingress of such cold water into said tank, a sealed motor-compressor unit, a condenser, an evaporator, and an internal sub-cooling coil, said internal sub-cooling coil being separate from said condenser and said internal sub-cooling coil being mounted in the bottom portion of said tank such that such cold water flowing from said intake opening initially flows in the immediate proximity of said internal sub-cooling coil.

* * * * *